US007979000B2

(12) United States Patent
Sekina et al.

(10) Patent No.: US 7,979,000 B2
(45) Date of Patent: Jul. 12, 2011

(54) TRANSFER UNIT AND IMAGE FORMING APPARATUS

(75) Inventors: Takuya Sekina, Yokohama (JP); Masaharu Furuya, Yokohama (JP); Katsuhito Haruno, Sagamihara (JP); Masakazu Imai, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 45 days.

(21) Appl. No.: 12/486,351

(22) Filed: Jun. 17, 2009

(65) Prior Publication Data

US 2010/0003051 A1 Jan. 7, 2010

(30) Foreign Application Priority Data

Jul. 4, 2008 (JP) ..... 2008-176264
Jul. 4, 2008 (JP) ..... 2008-176267

(51) Int. Cl.
*G03G 15/08* (2006.01)
*G03G 21/00* (2006.01)

(52) U.S. Cl. ..... 399/121; 399/124

(58) Field of Classification Search ..... 399/121, 399/124, 125

See application file for complete search history.

(56) References Cited

U.S. PATENT DOCUMENTS 6,678,490 B2 * 1/2004 Tanaka ..... 399/124
7,302,209 B2 * 11/2007 Kurita ..... 399/124
7,317,887 B2 * 1/2008 Otaka ..... 399/124
2006/0099008 A1 * 5/2006 Kurita ..... 399/124 X
2007/0248377 A1 * 10/2007 Palumbo et al. ..... 399/124 X
2008/0112734 A1 5/2008 Furuya et al.

FOREIGN PATENT DOCUMENTS

| | | |
|---|---|---|
| JP | 7-234595 | 9/1995 |
| JP | 9-292811 | 11/1997 |
| JP | 2000-356910 | 12/2000 |
| JP | 2002-311663 | 10/2002 |
| JP | 2006-290516 | 10/2006 |
| JP | 2007-70117 | 3/2007 |
| JP | 2007-148196 | 6/2007 |

OTHER PUBLICATIONS

U.S. Appl. No. 12/828,612, filed Jul. 1, 2010, Furuya, et al.

* cited by examiner

*Primary Examiner* — Sandra L Brase
(74) *Attorney, Agent, or Firm* — Oblon, Spivak, McClelland, Maier & Neustadt, L.L.P.

(57) ABSTRACT

A turnable transfer unit, including a transfer member forming a transfer nip while contacting an image bearer installed in an image forming apparatus; and a pressurizer pressurizing the transfer member to the image bearer, wherein the turnable transfer unit further includes a turnable lever member, including an engaging part engaging with a positioning part of the image forming apparatus; and a contact part contacting an opening and closing body openable and closable in the image forming apparatus, wherein the lever member turns in conjunction with a closing operation of the opening and closing body to position the transfer unit in the image forming apparatus.

18 Claims, 14 Drawing Sheets

--RELATED ART--

TRANSFER UNIT AND IMAGE FORMING APPARATUS

BACKGROUND OF THE INVENTION

1. Field of the Invention

The present invention relates to a transfer unit transferring an image on an image bearer onto a recoding medium, and an image forming apparatus such as a multifunctional apparatus equipped with at least one of copier, a printer, a facsimile and a plotter having the transfer unit.

2. Discussion of the Background

A transferer or a transfer unit used in an image forming apparatus is conventionally known to have a transfer roller and contact the transfer roller to a drum-shaped or an endless-belt-shaped image bearer upon application of pressure.

Such a transferee applies a bias voltage to the transfer roller or a roller facing the transfer roller, passes a transfer paper between the image bearer and the transfer roller to transfer a toner image formed on the image bearer onto a transfer paper with a pressure and an electrostatic force.

A typical second transfer unit 90 is shown in FIG. 15. A second transfer roller 5 is rotatably held by a transfer unit 91 and displaceably located in a direction contacting to and separating from an image bearer of an image forming apparatus (not shown) under biasing force of a spring 93.

The transfer unit 91 has a turning support point 94 for axially supporting the image forming apparatus or a both side unit (not shown) at the bottom. The second transfer unit 90 is pressurized by the both side unit (not shown) through a plate spring 95 when installed in the image forming apparatus so as to hit a protrusion 96 to a fixing unit frame (not shown) of the image forming apparatus such that the second transfer unit 90 is positioned therein.

The second transfer roller 5 contacts the image bearer of the image forming apparatus before the protrusion 96 and the spring 93 is compressed to obtain a predetermined transfer nip pressure.

Japanese published unexamined application No. 2007-148196 discloses an image forming apparatus, in which a second transfer unit is turnably held on the inside face of a both side unit and a L-shaped lock member projected from the inside face of a top edge thereof engages with a bar member of the image forming apparatus such that the second transfer unit and the both side unit are positioned therein, and both collars of the second transfer roller engage with a vertical positioning member of the image forming apparatus such that the second transfer roller is vertically positioned.

The second transfer unit is overall positioned in an image forming apparatus when protrusions 116 formed on inner both ends of the both side unit presses a contact part of 104 of the backside of the second transfer unit (the opposite side face of the second transfer roller).

Since the method of Japanese published unexamined application No. 2007-148196 is a press method with a protrusion as mentioned above, a large force is required to close the both side unit, resulting in deterioration of operability.

Namely, in either of the engagement between the lock member and the bar member or the contact between the contact part and the protrusion, the members serially operates each other, in other words, a positioning force operates in a linear direction and only a turning operation of the both side unit can position the second transfer unit. However, the operation force is inevitably large because of directly receiving a reaction force of the spring pressing the second transfer roller.

A force from the both side unit becomes large in proportion to a pressure of the second transfer roller to the image bearer, and a large force is required to close the both side unit in an image forming apparatus needing a large transfer pressure, resulting in deterioration of operability.

In addition, such a transferer presses the transfer roller to the image bearer even when a toner image is not transferred and the transfer roller is noticeably deformed with pressure if it is formed with a soft material such as sponge rubber and foamed urethane, resulting in defective transfer.

In order to solve this problem, the transfer roller is forcibly separated from the image bearer when a toner image is not transferred or a paper is jammed at a transfer site.

For example, when a predetermined time has passed since the final job was finished or a jamming occurred, a cam equipped in the image forming apparatus is driven to press the transfer roller or the transfer roller holding member such that the transfer roller and the image bearer are separated from each other.

When the both side unit and transfer unit are opened and closed while the transfer roller is separated from the image bearer, a force larger than a closing force while the transfer roller contacts the image bearer is required.

Namely, an extra force is required because the transfer roller and the image bearer are separated from each other by the cam.

Because of these reasons, a need exists for a transfer unit having improved operability and usability, capable of reducing a force for positioning the unit in an image forming apparatus.

SUMMARY OF THE INVENTION

Accordingly, an object of the present invention is to provide a transfer unit having improved operability and usability, capable of reducing a force for positioning the unit in an image forming apparatus.

Another object of the present invention is to provide an image forming apparatus using the transfer unit.

These objects and other objects of the present invention, either individually or collectively, have been satisfied by the discovery of a turnable transfer unit, comprising:

a transfer member configured to form a transfer nip while contacting an image bearer installed in an image forming apparatus; and a pressurizer configured to pressurize the transfer member to the image bearer, wherein the turnable transfer unit further comprises a turnable lever member, comprising:

an engaging part configured to engage with a positioning part of the image forming apparatus; and a contact part configured to contact an opening and closing body openable and closable in the image forming apparatus, wherein the lever turns in conjunction with a closing operation of the opening and closing body to position the transfer unit in the image forming apparatus.

Alternatively, the present invention relates to a turnable transfer unit, comprising:

a transfer member configured to form a transfer nip while contacting an image bearer installed in an image forming apparatus; and a pressurizer configured to pressurize the transfer member to the image bearer, wherein the turnable transfer unit further comprises a turnable lever member, comprising:

a turnable second lever comprising an engaging part configured to engage with a positioning part of the image forming apparatus;

a turnable first lever comprising a contact part configured to contact an opening and closing body openable and closable in the image forming apparatus; and an elastic member formed between the first and the second levers and configured to turn the second lever in the same direction as that of the first lever turned by the engaging part to an engaging direction to the positioning part, wherein the lever member turns in conjunction with a closing operation of the opening and closing body to position the transfer unit in the image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a transfer unit having improved operability and usability, capable of reducing a force for positioning the unit in an image forming apparatus. More particularly, the present invention relates to a turnable transfer unit, comprising:

a transfer member configured to form a transfer nip while contacting an image bearer installed in an image forming apparatus; and a pressurizer configured to pressurize the transfer member to the image bearer, wherein the turnable transfer unit further comprises a turnable lever member, comprising:

an engaging part configured to engage with a positioning part of the image forming apparatus; and a contact part configured to contact an opening and closing body openable and closable in the image forming apparatus, wherein the lever member turns in conjunction with a closing operation of the opening and closing body to position the transfer unit in the image forming apparatus.

Alternatively, the present invention relates to a turnable transfer unit, comprising:

a transfer member configured to form a transfer nip while contacting an image bearer installed in an image forming apparatus; and a pressurizer configured to pressurize the transfer member to the image bearer, wherein the turnable transfer unit further comprises a turnable lever member, comprising:

a turnable second lever comprising an engaging part configured to engage with a positioning part of the image forming apparatus;

a turnable first lever comprising a contact part configured to contact an opening and closing body openable and closable in the image forming apparatus; and an elastic member formed between the first and the second levers and configured to turn the second lever in the same direction as that of the first lever turned by the engaging part to an engaging direction to the positioning part, wherein the lever member turns in conjunction with a closing operation of the opening and closing body to position the transfer unit in the image forming apparatus.

Figure 1:
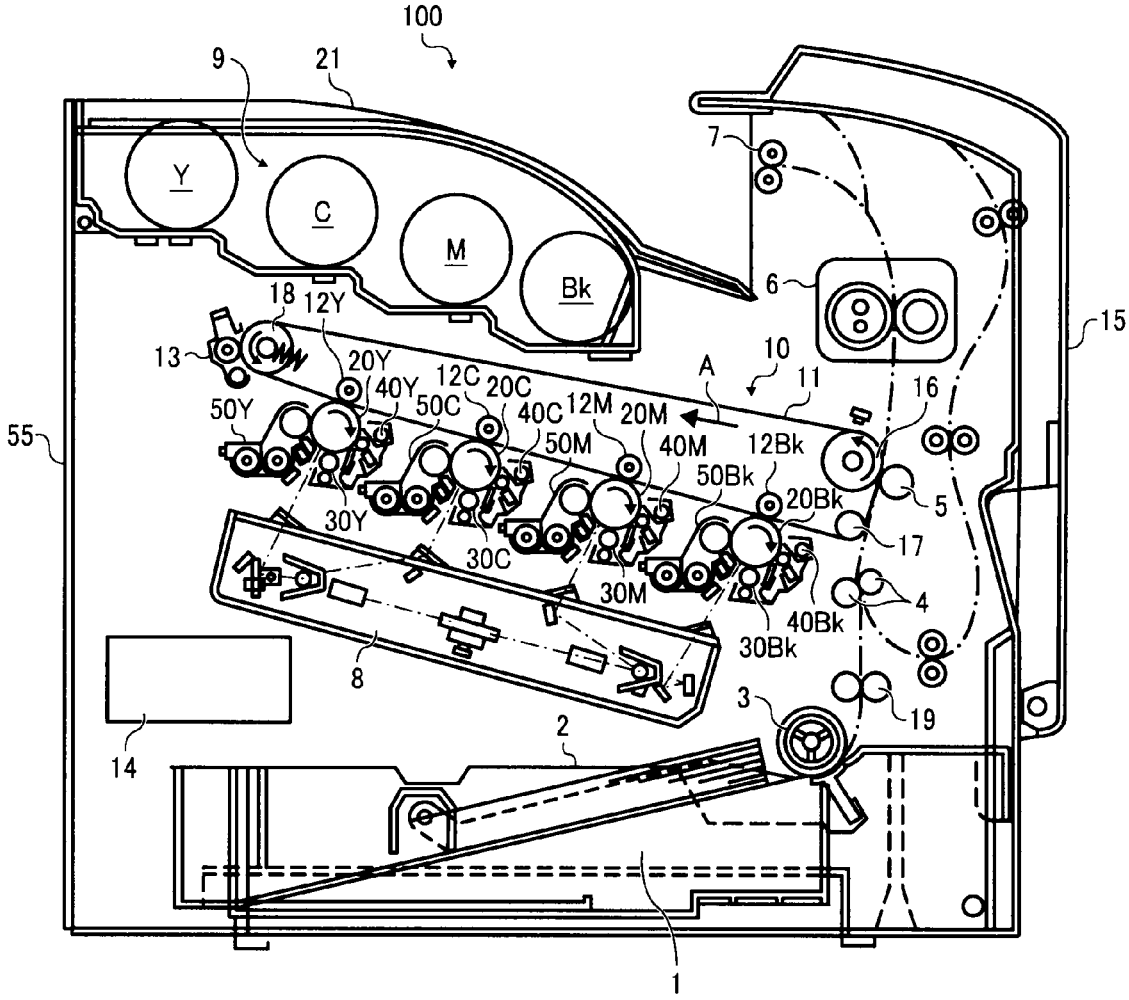
FIG. 1 is a schematic view illustrating a color printer as an image forming apparatus relative to a first embodiment of the present invention.

Hereinafter, an embodiment of the present invention will be explained, referring to the drawings. First, a first embodiment will be explained, based on FIG. 1 or FIG. 12. The same part uses the same symbol. FIG. 1 is a color printer as an image forming apparatus. As shown in FIG. 1, a color printer 100 includes a transfer belt unit 10 having an intermediate transfer belt 11 as an image bearer and four image stations. Each of the image stations has photoreceptor drums 20Y, 20C, 20M and 20Bk, and exclusive chargers 30Y, 30C, 30M and 30Bk, image developers 50Y, 50C, 50M and 50Bk, cleaners 40Y, 40C, 40*m* and 40Bk around the photoreceptor drums.

The intermediate transfer belt 11 is supported by a support rollers 16, 17 and 18, and the support roller 16 faces a second transfer roller 5 and the support roller 18 faces an intermediate transfer belt cleaner.

A numeral 9 is a toner bottle container including a toner bottle filled with a yellow toner (Y), a toner bottle filled with a cyan toner (C), a toner bottle filled with a magenta toner (M) and a toner bottle filled with a black toner from left to right in FIG. 1, and from which a predetermined amount of the toner is fed to each of the image developers 50Y, 50C, 50M and 50Bk through a feeding route (not shown).

A transfer paper 2 as a recoding medium is fed from a paper feeding cassette 1 by a paper feed roller 3, and transported to a pair of registration rollers 4 by a pair of transport rollers 19.

A sensor (not shown) detects the transfer paper 2 reaching the pair of registration rollers 4, which transports the transfer paper 2 to a (transfer) nip between the second transfer roller 5 and the intermediate transfer belt 11, determining the timing with a detected signal.

The photoreceptor drums 20Y, 20C, 20M and 20Bk previously charged by the chargers 30Y, 30C, 30M and 30Bk are scanned by an irradiator 8 with a laser beam to form an electrostatic latent image on each of the photoreceptor drums 20Y, 20C, 20M and 20Bk. Each of the electrostatic latent images are developed by each of the image developers 50Y, 50C, 50M and 50Bk to form a yellow, a cyan, a magenta and a black toner image on each surface of the photoreceptor drums 20Y, 20C, 20M and 20Bk, respectively.

Next, a voltage is applied to each of first transfer rollers 12Y, 12C, 12M and 12Bk to sequentially transfer the toner images on the photoreceptor drums 20Y, 20C, 20M and 20Bk onto the intermediate transfer belt 11. Then, the toner images of each color are transferred from upstream to downstream with delayed timing so as to be overlapped on the same position of the intermediate transfer belt 11.

An image overlapping each color formed on the intermediate transfer belt 11 is transported to the second transfer roller 5 and second-transferred onto a transfer paper 2 at a time. The transfer paper 2 on which the image overlapping each color is transferred is transported to a fixer 6, where the image is fixed thereon with heat, and discharged on a tray 21 on the top of the image forming apparatus.

Namely, the image forming apparatus relative to this embodiment is a vertical transport image forming apparatus transporting a transfer paper from paper feeding cassette located below toward a transfer nip located above.

A toner remaining on each of the photoreceptor drums 20Y, 20C, 20M and 20Bk is cleaned by each of the cleaners 40Y, 40C, 40*m* and 40Bk, and then applied with a DC bias overlapped with an AC bias to the photoreceptor drums 20Y, 20C, 20M and 20Bk by the chargers 30Y, 30C, 30M and 30Bk to discharge and charge them at the same time and they are ready for a following image formation.

A toner remaining on the intermediate transfer belt 11 is cleaned by an intermediate transfer belt cleaner 13, and the intermediate transfer belt 11 is ready for a following image formation.

When the both sides of the transfer paper 2 are printed, it is lead to a both side unit 15, where it is reversed and transported to the pair of registration rollers 4. In FIG. 1, a numeral 55 is an image forming apparatus and 14 is a waste toner collection container collecting a waste toner after a toner image is transferred.

The both side unit 15 includes at least a both side transport route, openable and closable at an image forming apparatus 55. "Openable and closable" includes both meanings of "turnable" and "slidable".

The both side unit 15 may include a skid for transporting the transfer paper 2 while sandwiching it, a manual tray, a paper feeding skid feeding the transfer paper 2 from the manual tray to the second transferee and a driver such as a motor driving the transport skid and paper feeding skid.

Figure 2:
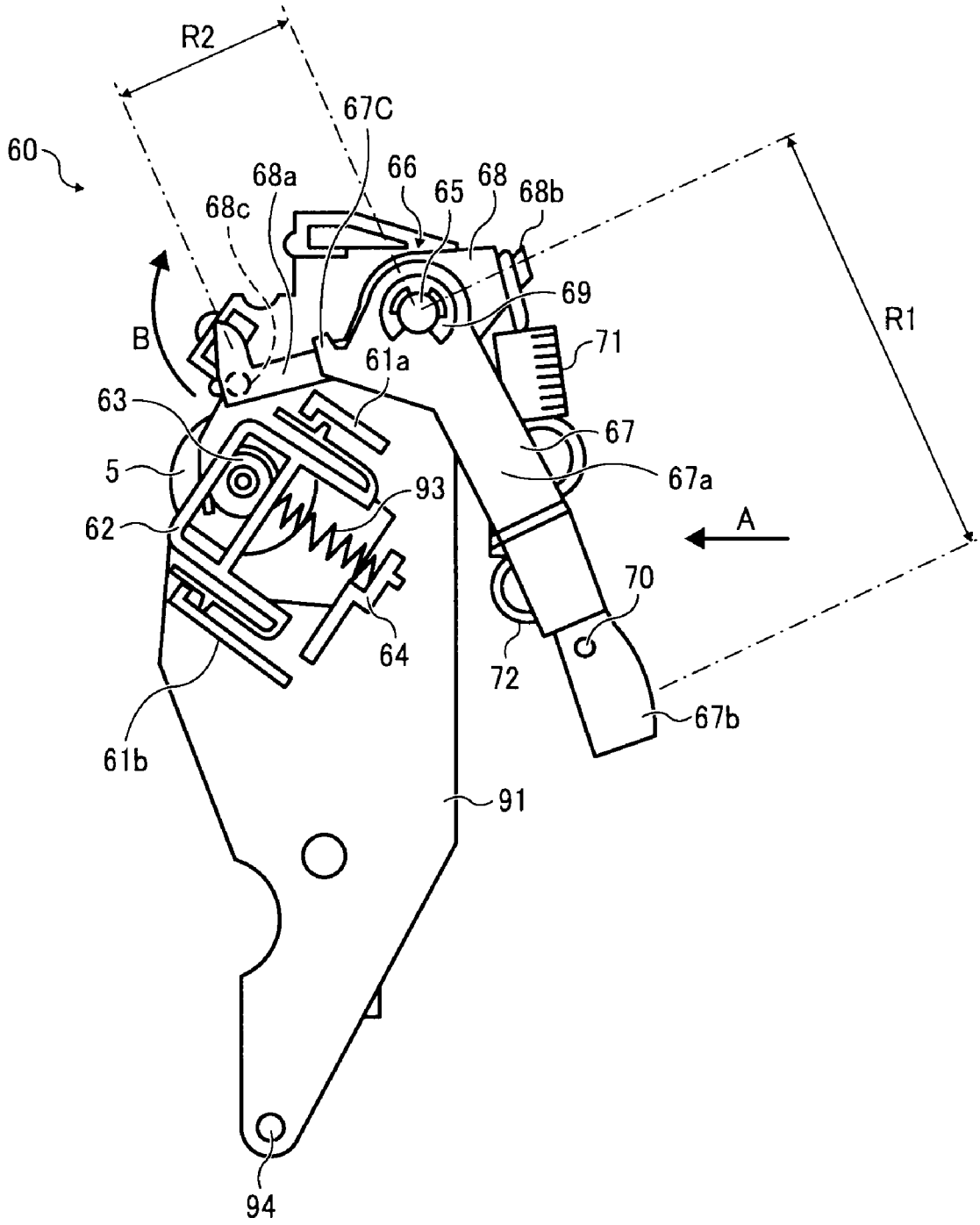
FIG. 2 is a schematic lateral view illustrating a second transfer unit as a transfer unit.

FIG. 2 is a second transfer unit as a transfer unit. The second transfer unit 60 (omitted in FIG. 1) is turnably and axially supported by a turnable supporting point 94 on the image forming apparatus 55. A second transfer roller 5 as a transfer member is rotatably supported by a bearing 63 fixed on a slider 62 sliding while guided by guides 61*a* and 61*b* formed on a transfer unit 91. A spring 93 as a pressurizer is located between a spring bearing 64 formed on the transfer unit 91 and the slider 62. Above the transfer unit 91, an axis (hereinafter referred to as a "turnable supporting point") 65 extending almost in parallel with the second transfer roller 5 is located, and a lever member 66 is turnably supported thereby.

The lever member 66 has a first lever 67 located outside and diagonally extending downward and a second lever 68 located inside. An E ring 69 regulates these levers from being displaced or dropped out in the axial direction. The first lever 67 and the second lever 68 are separate from each other at an interval in the turning direction, and they have a positional angle difference about 90° in this embodiment.

The first lever 67 has a contact part 67*b* contacting a both side unit 15 as an opening and closing body mentioned later at lower end, and the contact part 67*b* is fixed on a first lever body 67*a* with a bolt 70 and a nut (not shown). In this embodiment, the first lever body 67*a* is formed of a metal and the both side unit 15 and the contact part 67*b* are formed of synthetic resins to cushion the contact shock therebetween. As a matter of course, the first lever 67 may wholly be formed of a single metal or a resin.

Figure 4:
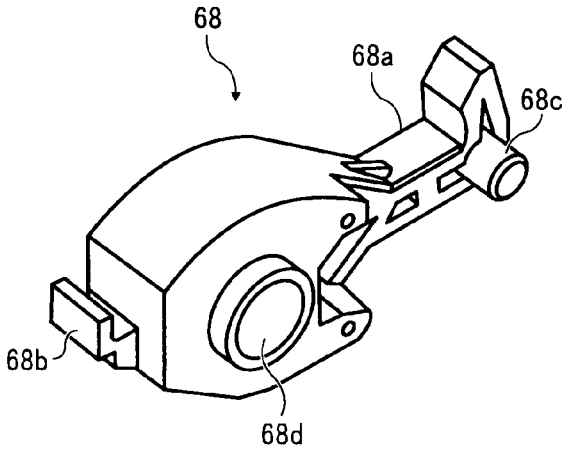
FIG. 4 is a perspective view illustrating a second lever.

The second lever 68 is formed of a synthetic resin as a single piece as shown in FIG. 4, and has an L-shaped engaging part 68*a* at the tip, a spring locking part 68*b* at the back end and a cylindrical projection 68C inside in the axial direction. A numeral 68*d* is an insert hole to an axis 65.

Figure 3:
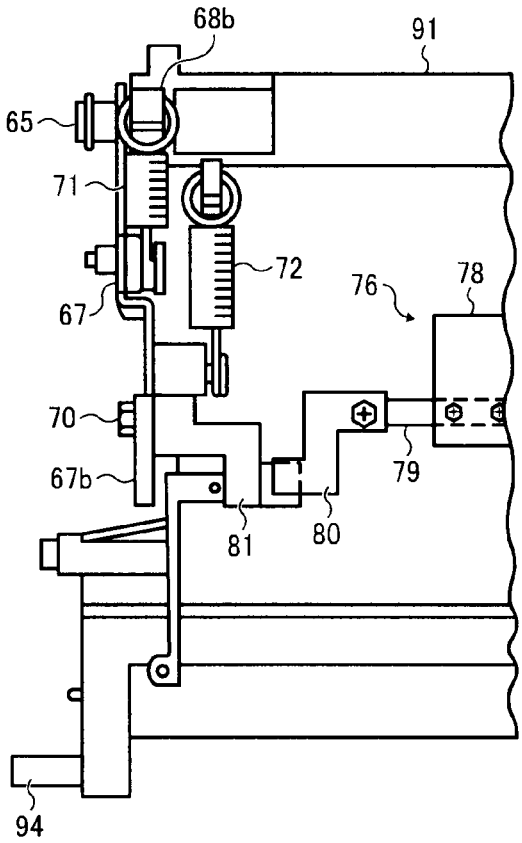
FIG. 3 is a schematic back view illustrating the second transfer unit.

As shown in FIGS. 2 and 3 (a back view of the transfer unit body seen from A in FIG. 2), a tensile spring 71 biasing the second lever 68 in the engaging direction (indicated by an arrow B) is located between the first lever 67 and the second lever 68. A locking chip 67*c* formed on the first lever body 67*a* regulates the turnable upper limit position of the second lever 68. This enables the first lever 67 and the second lever 68 to turn in a body.

The tensile spring 71 works as a cushion member when the engaging part 68*a* is engaged in the positioning part of the image forming apparatus 55 mentioned later.

Instead of the tensile spring 71, a link joint (joint member) may joint the both levers to form a joint allowance for cushion. The link joint may be an elastic body such as rubber. Further, instead of the tensile spring 71, a torsion spring may be placed on the axis 65 to bias the second lever 68 toward B and have cushionability.

Between the transfer unit 91 and the first lever 67, a tension spring 72 as a bias means holding the lever member 66 is located such that the engaging part 68*a* does not reach the engaging position at a turning position (in FIG. 2; hereinafter referred to as an "initial position") to while the second transfer unit 60 is not positioned to the image forming apparatus 55.

Figure 5:
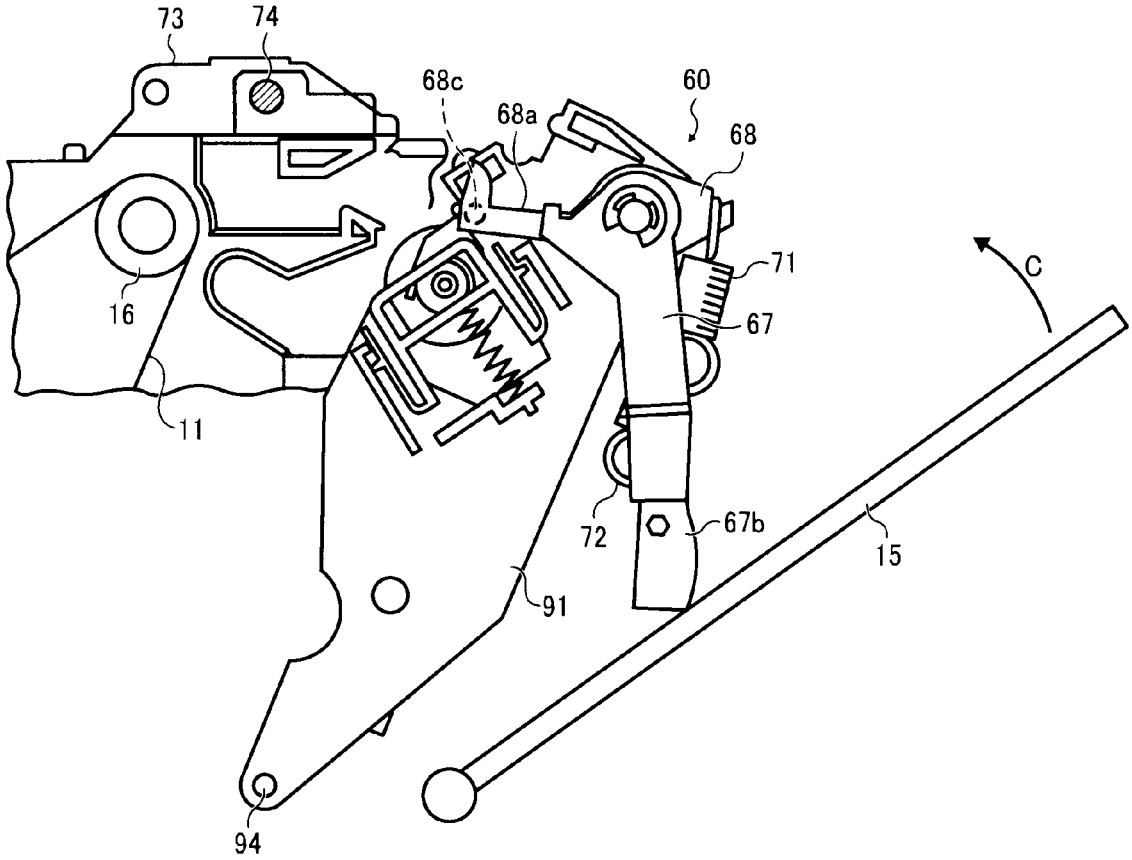
FIG. 5 is a schematic lateral view illustrating a both side unit and the second transfer unit when opened.

FIG. 5 shows that the both side unit 15 and the second transfer unit 60 are opened at maximum. The tensile spring 72 has a spring force balancing with a pressure of the both side unit 15, and a turning position of the lever member 66 is maintained at the initial position in FIG. 2. A cylindrical stud 74 as a positioning part for positioning the second transfer unit 60 is located at a frame of an intermediate transfer unit 73 of the image forming apparatus 55. The positioning is made when the engaging part 68*a* of the second lever 68 engages with the stud 74.

When the second transfer unit 60 is positioned to the image forming apparatus 55, an operator does not have to place a hand on the first lever 67 of the lever member 66 and has only to move the both side unit 15 in the direction indicated by an arrow C. Namely, the second transfer unit 60 is positioned in conjunction with closing of the both side unit 15.

The stud 74 may be located at apart besides the intermediate transfer unit 73 of the image forming apparatus 55, but the second transfer unit 60 is more precisely positioned when the stud is located at the intermediate transfer unit 73.

Figure 6:
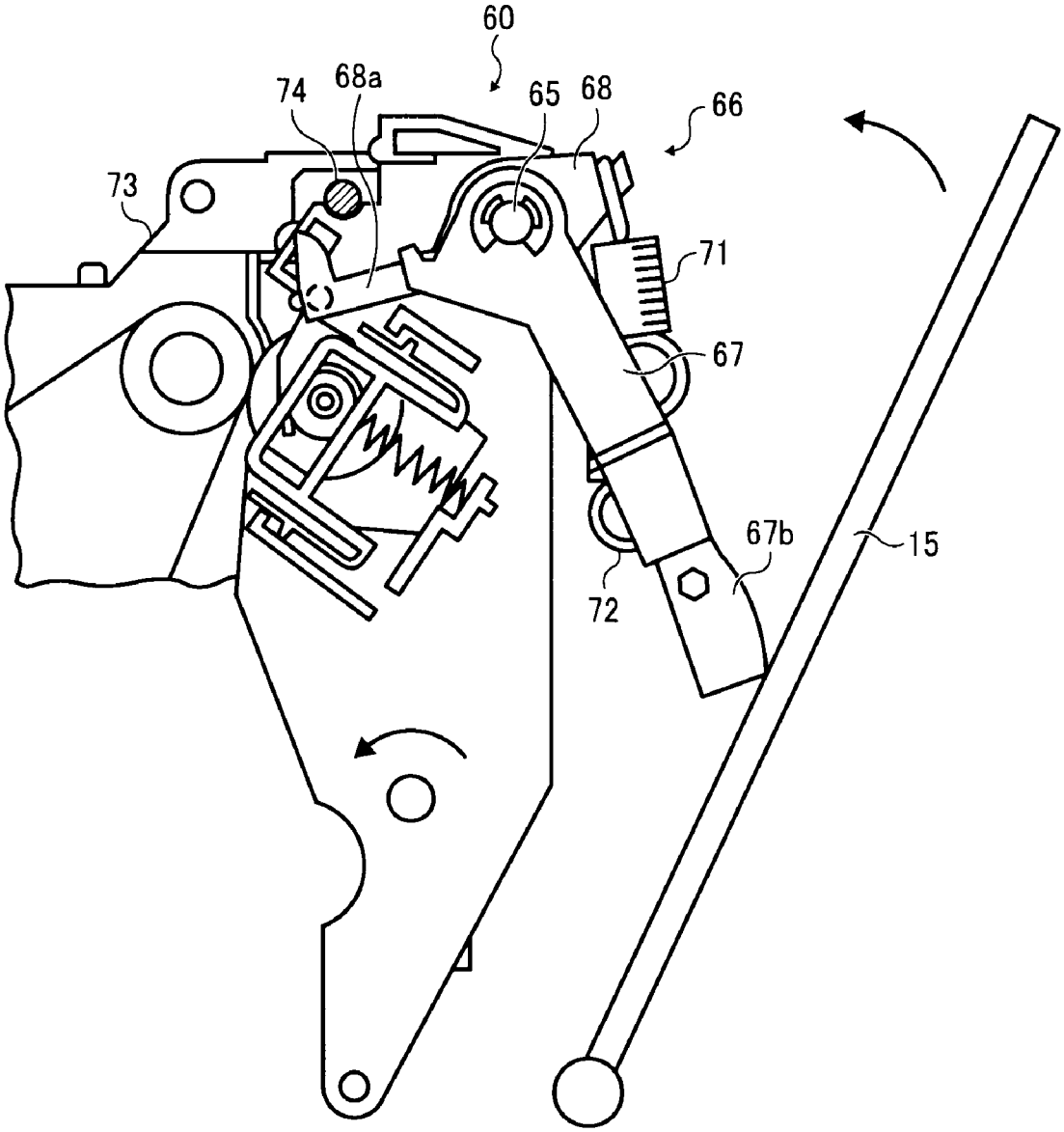
FIG. 6 is a schematic lateral view illustrating the both side unit turning to position the second transfer unit.

In the closing operation of the both side unit 15, as shown in FIG. 6, the initial position of the lever member 66 is maintained until the second transfer roller 5 contacts the intermediate transfer belt 11 as an image bearer.

When the second transfer roller 5 contacts the intermediate transfer belt 11, the lever member 66 begins to turn in the engaging direction (B direction) as the both side unit closes, receiving a pressure of the spring 93 as a pressurizer, because the tensile spring 72 has a spring force (spring constant) smaller than that of the spring 93.

Figure 7:
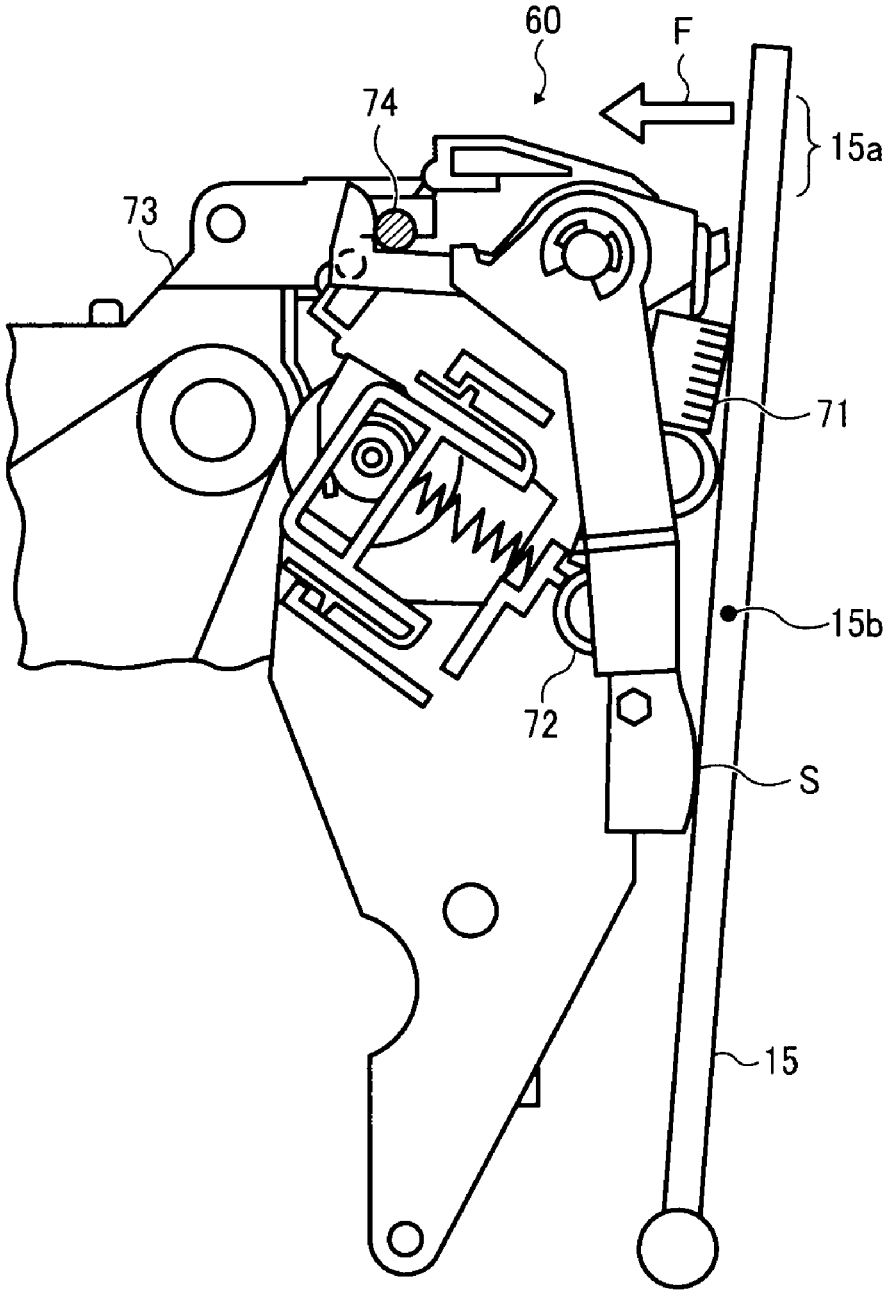
FIG. 7 is a schematic lateral view illustrating the second transfer unit being positioned in an image forming apparatus.

Finally, as shown in FIG. 7, the engaging part 68*a* of the second lever 68 engages with the stud 74 such that the second transfer unit 60 is positioned to the image forming apparatus 55. The both side unit 15 is locked with the image forming apparatus 55 as well by an engaging means (not shown).

Figure 8A:
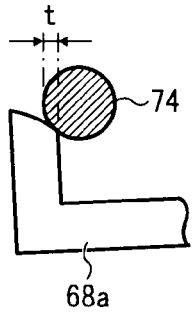
FIGS. 8A and 8B are enlarged views illustrating a main part of an engager before and after engaging a stud, respectively.
Figure 8B:
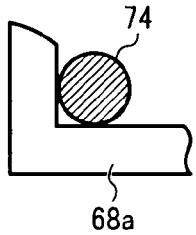

When the second transfer roller 5 contacts the intermediate transfer belt 11, as shown in FIG. 8A, there is a distance t between the engaging part 68*a* and the stud 74. The second transfer unit 60 further moves for the distance t to complete positioning of the second transfer unit 60 to the image forming apparatus 55 as shown in FIG. 8B. The distance t is a moving distance applying a predetermined nip pressure between the second transfer roller 5 and the intermediate transfer belt 11 while the spring 93 is pressed. A large setting force has been conventionally needed to directly press a reaction force of the spring 93.

In this embodiment, as shown in FIG. 2, since a distance R1 from the turnable supporting point 65 to the contact part 67*b* is different from a distance R2 therefrom to the engaging part 68*a* (R1/R2 is 2/1), the principle of leverage due to a lever ratio between the first lever 67 and the second lever 68 can reduce the pressure to the contact part 67*b* more than the conventional method directly receiving the reaction force of the spring 93, and can engage the engaging part 68*a* with the stud 74 with a force smaller than that of the conventional method. In other words, the both side unit 15 presses the contact part 67*b* with less set force when engaging.

The less set force can make the both side unit 15 (opening and closing body) lighter and smaller. The spring force of the tensile spring 71 is stronger than the reaction force of the spring 93 when the lever member 66 rigidly engages with the stud 74 such that the tensile spring 71 has cushionability.

As shown in FIG. 7, the position S of the contact part 67*b* of the lever member 66 is located below an operation position 15*a* of the both side unit 15. In this embodiment, the position S is still below a middle position 15B of the both side unit 15.

A setting force F can be smaller than that when the pressure position S is equivalent to the operation position 15*a* because of the principle of leverage due to a difference between a from the turning support of the both side unit 15 to the pressure position S to the contact part 67*b* and a distance between the turning support and the operation position 15*a*. In combination with the setting force reduction using the principle of leverage due to the above-mentioned lever ratio, the setting force can be reduced much more than conventional.

Figure 15:
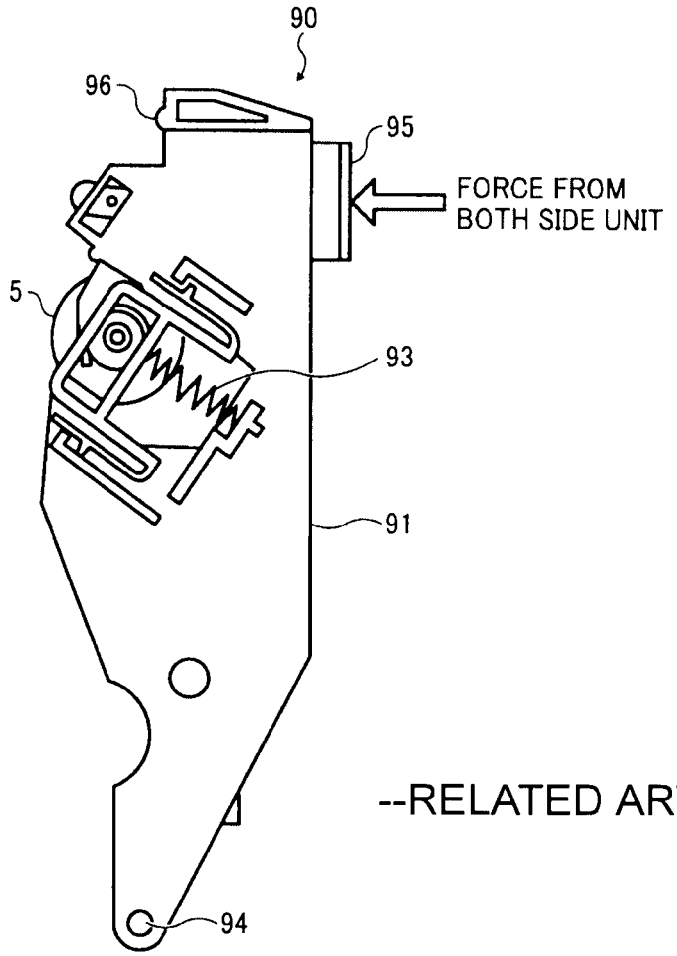
FIG. 15 is a schematic lateral view illustrating a conventional second transfer unit.

The setting force measured by a force gauge when the conventional second transfer unit shown in FIG. 15 is used was 76.6 N, but was 54.6 N when the constitution of this embodiment is used. The operation position 15*a* of the both side unit 15 means a mark conforming to a standard if there is, and the top end or the neighborhood thereof if there is no mark.

When the engagement of the both side unit 15 with the image forming apparatus 55 is released and opened, the spring force of the tensile spring 72 is set such that the lever member 66 turns and the engagement of the engaging part 68*a* with the stud 74 is released to automatically release the second transfer unit 60.

Since the tensile spring 72 automatically turns the second transfer unit 60 when the both side unit 15 is opened, only a biasing force capable of releasing the engagement with the stud 74 is needed, and which is preferably small. This is because the biasing force of the tensile spring 72 increases the operation force.

Figure 9:
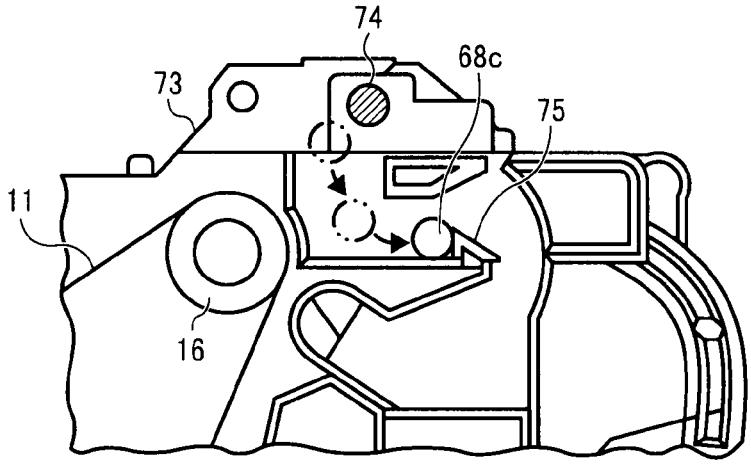
FIG. 9 is a schematic view illustrating a stopper formed on an intermediate transfer unit.

As shown in FIG. 9, the intermediate transfer unit 73 includes a stopper 75 holding an opening angle of the second transfer unit 60 at a predetermined angle in a body.

When the both side unit 15 is opened, as mentioned above, the stud 74 is automatically released from the engaging part 68*a* and the lever member 66 turns to the initial turning position. In this case, the projection 68*c* of the second lever 68 follows the track indicated by a two-dot chain line and hits the stopper 75, and the second transfer unit 60 is held open at a predetermined angle to the image forming apparatus 55.

Figure 10:
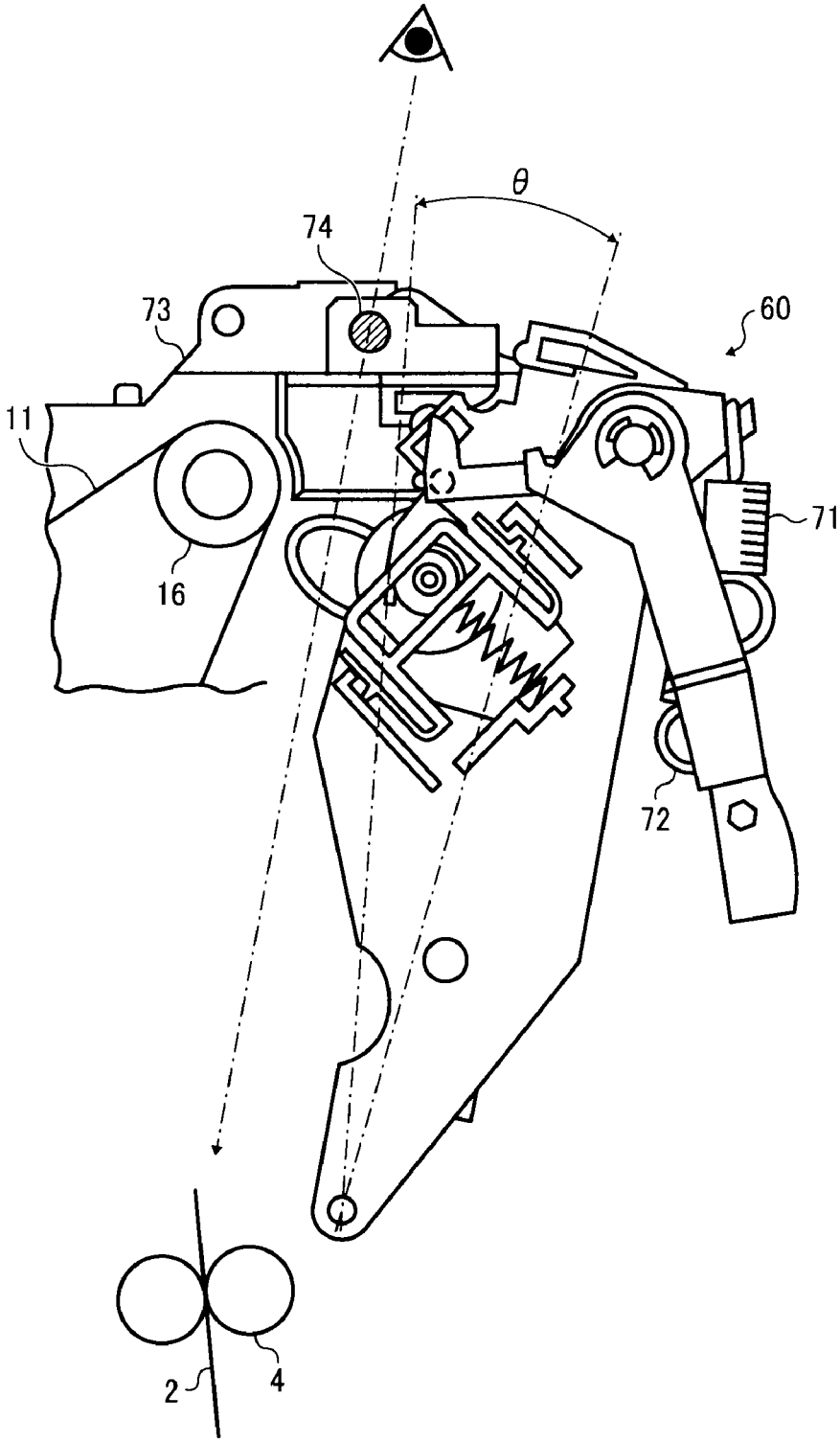
FIG. 10 is a schematic lateral view illustrating the second transfer unit opened by the stopper at a predetermined angle.

As shown in FIG. 10, the predetermined angle θ covers a range where both of the transfer nip and a pair of registration rollers 4 are visible from outside of the apparatus. An operator can see plural sites where paper jams are likely to occur at the same time and can easily identify sites where the paper jams occur.

When paper jams are resolved, the engagement between the projection 68*c* and the stopper 75 is released and the second transfer unit 60 is opened at maximum as shown in FIG. 5.

The disengagement with the stopper 75 is made by a releaser 76 formed on the back of the transfer unit 91 as shown in FIG. 3.

The releaser 76 has a release lever 78, turning axis member 79 holding the release lever 78 and a bracket 80 synchronously turning with the release lever 78. The bracket 80 is partially facing a part of a release racket 81 formed on the first lever 67 in a body. When the release lever 78 is raised, the first lever 67 turns in the direction of engaging with the stud 74. Then, the engagement between the projection 68*c* and the stopper 75 is released and the lever member 66 turns to the initial position.

Figure 11A:
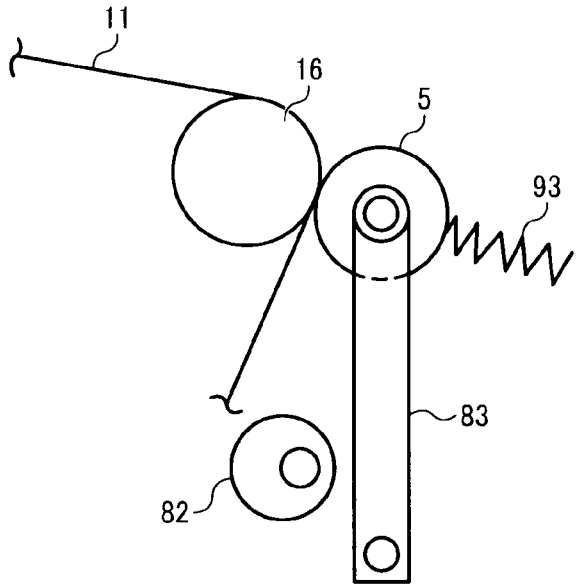
FIGS. 11A and 11B are schematic views illustrating the second transfer roller before and after separating, respectively.
Figure 11B:
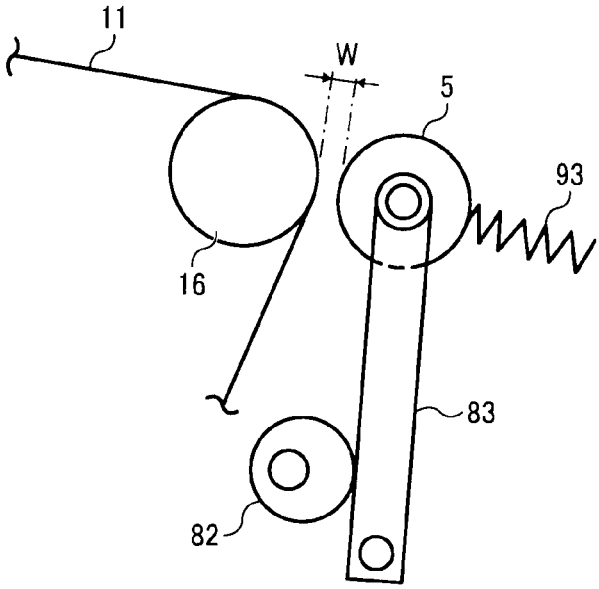

As shown in FIG. 11, in a color printer 100 relative to this embodiment, when a predetermined time has passed since the final job was finished or a predetermined time has passed since paper jams occurred at the transfer nip and the apparatus stopped, the second transfer roller 5 is forcibly separated from the intermediate transfer belt 11 to prevent defective transfers due to pressure deformation of the second transfer roller 5.

The image forming apparatus 55 has an eccentric cam 82 pressing a bracket 83 holding the second transfer roller 5 to separate the second transfer roller 5. The shapes of the eccentric cam 82 and the bracket 83 are shown differently from the actual.

While the second transfer roller 5 is separated at a distance w, when an operator opens and closes the second transfer unit 60 for resolving paper jams or carelessly irrespective of resolving paper jams, the lever member 66 begins to turn in the engaging direction sooner for the distance w. Accordingly, the lever member 66 reaches the engaging position before the engaging part 68*a* of the second lever 68 engages with the stopper 75, and is unengageable.

Figure 12:
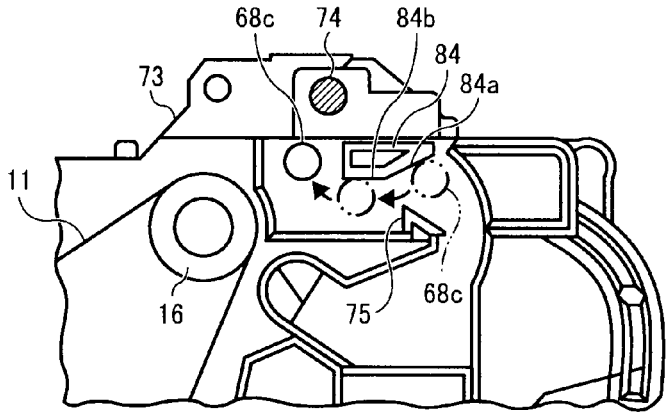
FIG. 12 is a schematic view illustrating a guide formed on the intermediate transfer unit.

In this embodiment, as shown in FIG. 12, the intermediate transfer unit 73 includes a guide 84 guiding the projection 68*c* of the second lever 68 in a body to prevent this.

The guide 84 has an inclined surface 84*a* expanding outside at an approach side of the projection 68*c* and a parallel surface 84*b* holding the projection 68*c* until it can engage with the stud 74.

Since the projection 68*c* is forcibly prevented to move up by the guide 84, the engaging part 68*a* is prevented to move up sooner and the projection 68*c* can reliably engage with the stud 74. Therefore, while the second transfer roller 5 is separated, even when an operator carelessly opens the both side unit 15, it can prevent the second transfer unit 60 from being defectively set.

Figure 13:
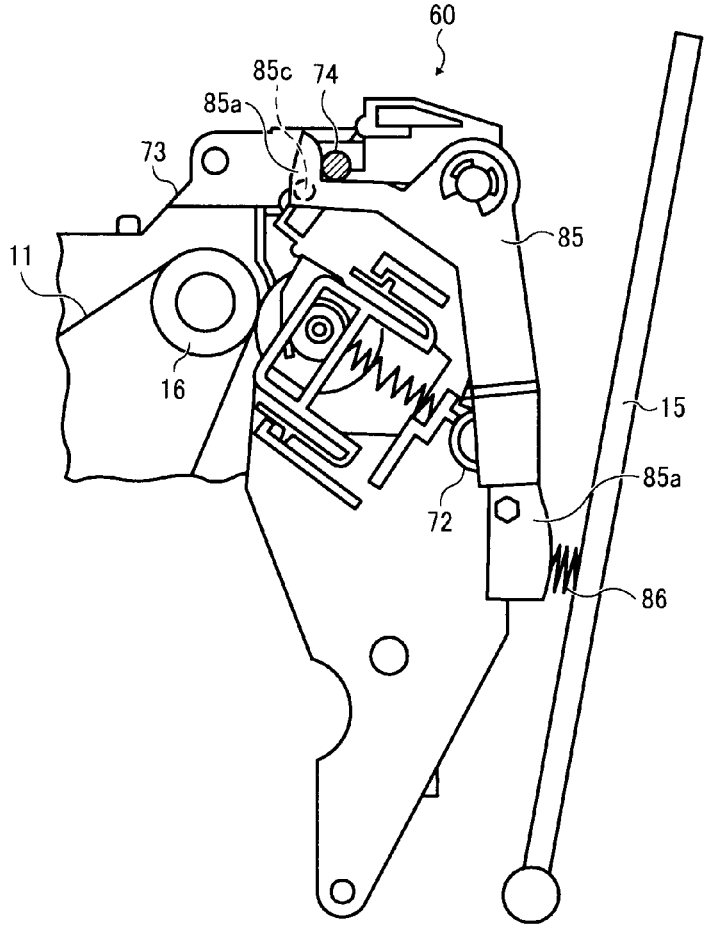
FIG. 13 is a schematic lateral view illustrating the second transfer unit being positioned in an image forming apparatus relative to a second embodiment of the present invention.

FIG. 13 is a second embodiment. The same parts have the same symbols in the above-mentioned embodiment. Explanations of the constitutions and functions already explained are omitted and only the main parts will be explained unless particularly necessary (Other embodiments are same).

In this embodiment, a lever member 85 is a unit body having a compressed spring 86 as an elastic member formed on a contact part 85*b*, which is a cushion when engaging with the stud 74. In FIG. 13, the both side unit 15 is almost upright.

A numeral 85*a* is the engaging part 68*a* and a numeral 85*c* is the projection 68*c* in the above-mentioned embodiment.

The lever member 66 in the first embodiment may be a unit body as the lever member 85 is.

Figure 14:
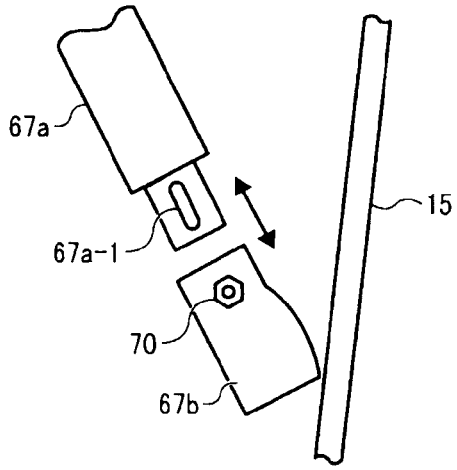
FIG. 14 is a schematic view illustrating a positioning adjustment structure of a contact part relative to a third embodiment of the present invention.

FIG. 14 is a third embodiment.

In this embodiment, the contact position of the contact part 67*b* of the lever member 66 to the both side unit 15 is adjustable. A long hole 67*a*-1 extending in the longitudinal direction of the first lever 67*a* is formed at the bottom end thereof. After the position of the contact part 67*b* is adjusted, it is fixed with a bolt 70 and a nut (not shown).

Thus, the contact position of the contact part 67*b* to the both side unit 15 and the setting force are adjustable, and which is applicable when the contact position with the both side unit 15 needs adjustment.

As a matter of course, the long hole may be formed at the contact part 67*b*. The contact part 67*b* can be screwed in the first lever body 67*a* and the position can be adjusted with a screw-in quantity.

In each of the above-mentioned embodiments, the second transfer unit 60 is turnably formed on the image forming apparatus 55. Even when the second transfer unit 60 is turnably formed on the both side unit 14, the setting force can be reduced as mentioned above.

In each of the above-mentioned embodiments, the constitution using an intermediate transfer belt as an image bearer is explained. However, the image bearer is not limited to the intermediate transfer belt and all image bearers such as photoreceptor drums, photoreceptor belts and intermediate transfer drums can be used. As for the transfer member, a transfer roller is explained as an example, and all transfer members such as transfer brushes and transfer blades can be used.

The opening and closing body may simply be a cover member besides the both side unit.

Figure 16:
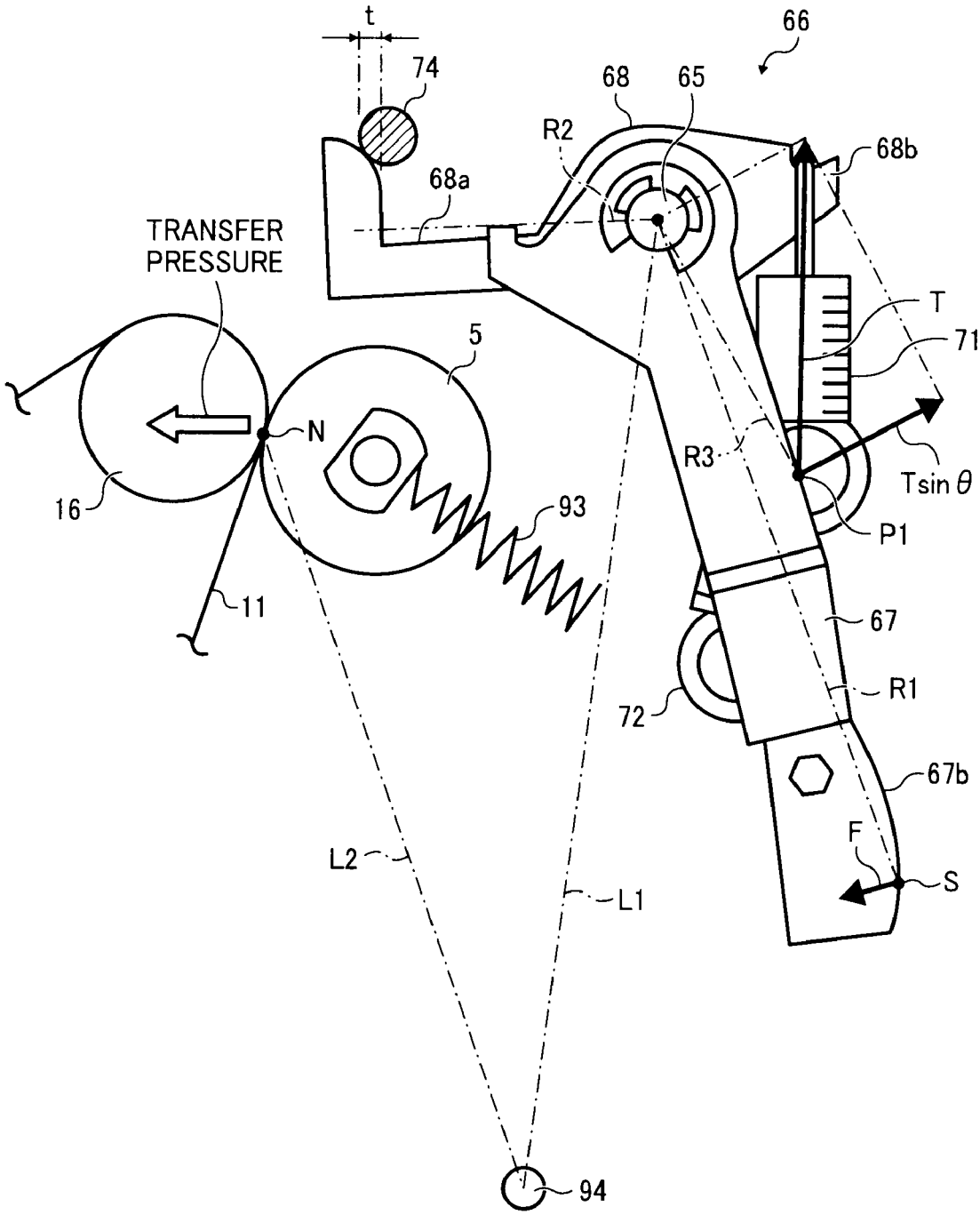
FIG. 16 is a schematic view for explaining a reduction principle of the setting force.

Further, as shown in FIG. 16, when the second transfer roller 5 contacts the intermediate transfer belt 11, there is a distance t between the engaging part 68*a* and the stud 74. The second transfer unit 60 further moves for the distance t to complete positioning of the second transfer unit 60 to the image forming apparatus 55.

The distance t is a moving distance applying a predetermined nip pressure between the second transfer roller 5 and the intermediate transfer belt 11 while the spring 93 is pressed. A large setting force has been conventionally needed to directly press a reaction force of the spring 93.

In this embodiment, since a distance R1 from the turnable supporting point 65 to the contact part 67*b* is different from a distance R2 therefrom to the engaging part 68*a* (R1/R2 is 2/1), the principle of leverage due to a lever ratio between the first lever 67 and the second lever 68 can reduce the pressure to the contact part 67*b* more than the conventional method directly receiving the reaction force of the spring 93, and can engage the engaging part 68*a* with the stud 74 with a force smaller than that of the conventional method. In other words, the both side unit 15 presses the contact part 67*b* with less set force when engaging.

The less set force can make the both side unit 15 (opening and closing body) lighter and smaller.

The reduction of the setting force will be explained in terms of a force acting on the tensile spring 71.

Supposing the tensile spring 71 is directly pulled without thinking of the presence of the first lever 67 to engage the engaging part 68*a* with the stud 74, extremely a large force T is needed.

In this embodiment, since the tensile spring 71 is connected with the-first lever 67 at a slant, a force at a connecting (hooking) part P1 to the first lever 67 is T sin θwhich is smaller than the force T.

Since a distance R1 from the turnable supporting point 65 to a contact point S of the contact part 67*b* is larger than a distance R3 therefrom to a spring connected part P1, a force F for engaging the engaging part 68*a* with the stud 74 is smaller by the principle of leverage due to a lever ratio.

Therefore, a setting force (an operation force of the both side unit 15) when the second transfer unit 60 is positioned on the image forming apparatus 55 can be reduced.

Furthermore, since a distance L1 from the turnable supporting point 65 to the turnable supporting point 94 of the transfer unit body 94 is larger than a distance L2 from a transfer nip thereto, the setting force is further reduced.

In other words, the first lever 67 and the second lever 68 are connected with each other with the tensile spring 71 in a body, the principle of leverage due to a lever ratio (R1/R2=1/2) can reduce the setting force.

The spring force of the tensile spring 71 is larger than a reaction force of the spring 93 when the lever member 66 engages with the stud 74 so as to rigidly be engaged therewith with a cushion.

Since the cushion with the tensile spring 71 can absorb a shock when the lever member 66 engages with the stud 74, it can prevent the first lever 67 and the second lever 68 from being broken when the lever member 66 is engaged therewith.

In addition, the setting force reduction can form the first lever 67 and the second lever 68 with inexpensive and light materials. Further, the tensile spring 71 as a connecting member combines a cushion member and a separate cushion member is not necessary to form, which is a cost reduction.

Figure 17:
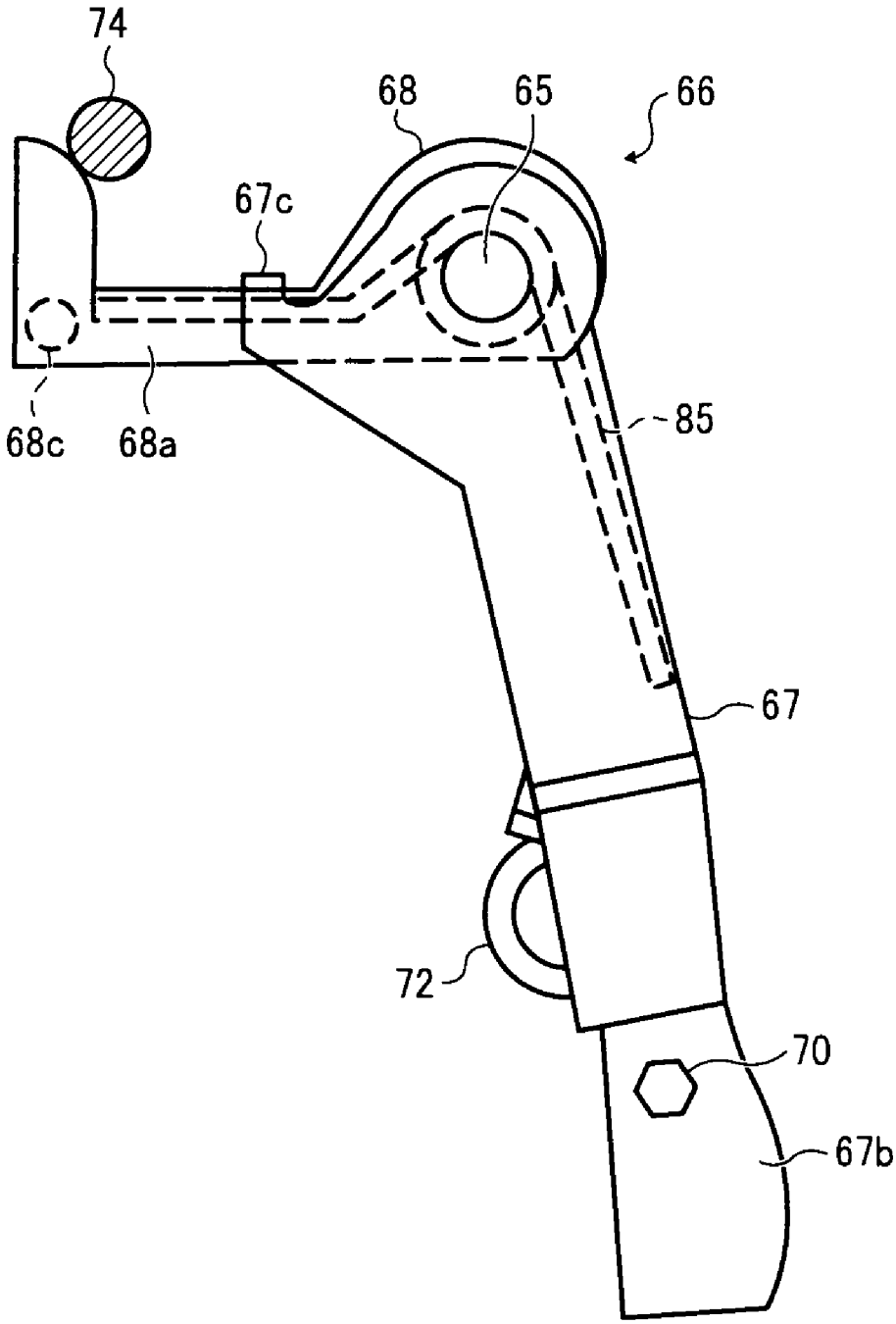
FIG. 17 is a schematic lateral view illustrating a fourth embodiment of the present invention.

FIG. 17 is a fourth embodiment.

In this embodiment, a torsion spring 85 is formed on an axis 65 as an elastic member, and an elastic force is developed against the direction approaching the first lever 67 (second lever 68) to the second lever 68 (first lever 67).

In this embodiment, the second lever 68 does not have a spring locking part 68*b* for the tensile spring 71.

In this embodiment as well, the principle of leverage due to a lever ratio (a difference of distances from the turnable supporting point) of the both levers can reduce the setting force, and the elasticity of the torsion spring 85 works as impact relaxation.

Figure 18:
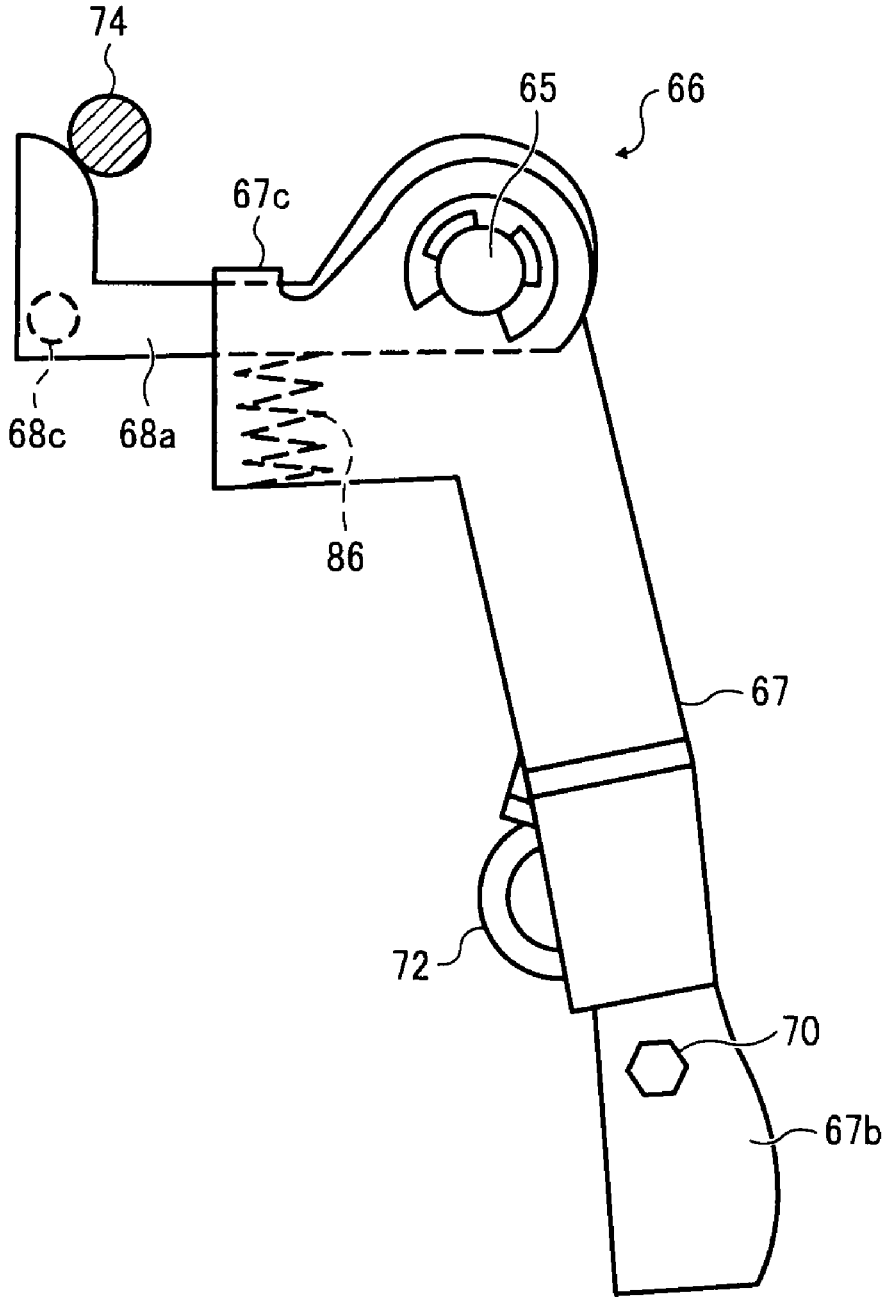
FIG. 18 is a schematic lateral view illustrating a fifth embodiment of the present invention.

FIG. 18 is a fifth embodiment.

In this embodiment, the first lever 67 has a shape slightly different from that of the above-mentioned embodiment, and a compressed spring 86 is formed between the first lever body 67*a* and the under surface of the second lever 68 as an elastic member.

In this embodiment, the second lever 68 does not have a spring locking part 68*b* for the tensile spring 71.

In this embodiment as well, the principle of leverage due to a lever ratio (a difference of distances from the turnable supporting point) of the both levers can reduce the setting force, and the elasticity of the compressed spring 86 works as impact relaxation. Elastic members such as rubbers may be used instead of the compressed spring 86.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

This application claims priority and contains subject matter related to Japanese Patent Applications Nos. 2008-176264 and 2008-176267, both filed on Jul. 4, 2008, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A turnable transfer unit, comprising:

a transfer member configured to form a transfer nip while contacting an image bearer installed in an image forming apparatus; and a pressurizer configured to pressurize the transfer member to the image bearer, wherein the turnable transfer unit further comprises a turnable lever member, comprising:

an engaging part configured to engage with a positioning part of the image forming apparatus; and a contact part configured to contact an opening and closing body openable and closable in the image forming apparatus, wherein the lever member turns in conjunction with a closing operation of the opening and closing body to position the transfer unit in the image forming apparatus.

2. The turnable transfer unit of claim 1, further comprising a biasing means configured to hold the lever member at a turning position where the engaging part does not reach an engaging position with the positioning part while the lever member is not positioned in the image forming apparatus.

3. The turnable transfer unit of claim 2, wherein the biasing means has such a biasing force that engagement of the engaging part and the positioning part is released in conjunction with an opening operation of the opening and closing body and the transfer unit can automatically separate from the image bearer.

4. The turnable transfer unit of claim 1, further comprising a cushion member cushioning an impact when the engaging part engages with the positioning part.

5. The turnable transfer unit of claim 1, wherein the contact part of the lever member is located below an operation position the opening and closing body.

6. An image forming apparatus comprising the turnable transfer unit according to claim 1.

7. The image forming apparatus of claim 6, wherein the engaging part of the lever member comprises a projection configured to be guided to a guide formed on the image forming apparatus, and wherein the guide has a shape capable of inhibiting the lever member from turning and the engaging part from reaching an engaging position before engaging with the positioning part.

8. The image forming apparatus of claim 6, further comprising a stopper configured to hold an opening angle of the transfer unit at a predetermined angle when the opening and closing body is opened.

9. The image forming apparatus of claim 8, wherein the opening and closing body is opened, the engaging part is released from the positioning part, the lever member turns and a projection engages with the stopper to hold the predetermined angle.

10. The image forming apparatus of claim 9, wherein the predetermined angle is in a scope where both of the transfer nip and pair of registration rollers feeding a recording medium to the transfer nip at a predetermined time are visible from outside of the apparatus.

11. The image forming apparatus of claim 9, further comprising a release means configured to release the projection form engaging with the stopper.

12. The image forming apparatus of claim 6, wherein the opening and closing body is a both side unit.

13. The image forming apparatus of claim 6, wherein the image bearer is an intermediate transfer belt.

14. A turnable transfer unit, comprising:

a transfer member configured to form a transfer nip while contacting an image bearer installed in an image forming apparatus; and a pressurizer configured to pressurize the transfer member to the image bearer, wherein the turnable transfer unit further comprises a turnable lever member, comprising:

a turnable second lever comprising an engaging part configured to engage with a positioning part of the image forming apparatus;

a turnable first lever comprising a contact part configured to contact an opening and closing body openable and closable in the image forming apparatus; and an elastic member formed between the first and the second levers and configured to turn the second lever in the same direction as that of the first lever turned by the engaging part to an engaging direction to the positioning part, wherein the lever member turns in conjunction with a closing operation of the opening and closing body to position the transfer unit in the image forming apparatus.

15. The turnable transfer unit of claim 14, wherein a distance between a turnable supporting point of the lever member and a turnable supporting point of the transfer unit is longer than a distance between the transfer nip and the supporting point of the transfer unit.

16. An image forming apparatus comprising the turnable transfer unit according to claim 14.

17. The image forming apparatus of claim 16, wherein the opening and closing body is a both side unit.

18. The image forming apparatus of claim 16, wherein the image bearer is an intermediate transfer belt.

* * * * *

UNITED STATES PATENT AND TRADEMARK OFFICE

CERTIFICATE OF CORRECTION

PATENT NO. : 7,979,000 B2
APPLICATION NO. : 12/486351
DATED : July 12, 2011
INVENTOR(S) : Takuya Sekine et al.

It is certified that error appears in the above-identified patent and that said Letters Patent is hereby corrected as shown below:

On the Title Page, Item (75), change the last name of the 1st inventor from "Sekina" to --Sekine--.

Signed and Sealed this
Sixteenth Day of October, 2012

David J. Kappos

David J. Kappos
*Director of the United States Patent and Trademark Office*